United States Patent [19]

Nakanishi et al.

[11] Patent Number: 5,024,133

[45] Date of Patent: Jun. 18, 1991

[54] ELECTRONIC MUSICAL INSTRUMENT WITH IMPROVED GENERATION OF WIND INSTRUMENTS

[75] Inventors: Masahiro Nakanishi, Yawata; Daisuke Mori, Kobe; Katsuyoshi Fujii, Moriguchi; Masahiko Hatanaka, Kadoma; Hiroko Shinada, Osaka, all of Japan

[73] Assignee: Matsushita Electric Industrial Co., Ltd., Kadoma, Japan

[21] Appl. No.: 348,526

[22] Filed: May 8, 1989

[30] Foreign Application Priority Data

May 17, 1988 [JP] Japan ..... 63-119564

[51] Int. Cl.[5] ..... G10H 1/18; G10H 1/46; G10H 7/10

[52] U.S. Cl. ..... 84/615; 84/633; 84/741; 84/742

[58] Field of Search ..... 84/603-607, 84/622-633, 735-742, 615

[56] References Cited

U.S. PATENT DOCUMENTS 4,301,704 11/1981 Nagai et al. ..... 84/633 X

OTHER PUBLICATIONS

John Backus and T. C. Hundley; "Harmonic Generation in the Trumpet"; The Journal of the Acoustical Society of America, vol. 49, No. 2, (Part 2), pp. 509-519, 1971.

Uno Ingard and Hartmut Ising; "Acoustic Nonlinearity of an Orifice"; The Journal of the Acoustical Society of America, vol. 42, No. 1, pp. 6-17, 1967.

*Primary Examiner*—Stanley J. Witkowski

*Attorney, Agent, or Firm*—Cushman, Darby & Cushman

[57] ABSTRACT

The purpose of the present invention is to offer an electronic musical instrument which can synthesize the sound of brass instruments with fidelity and furthermore in real time. In order to achieve the above purpose, the musical sound synthesis algorithm is to utilize the tonguing information as well as the embouchure information in addition to the sound generation information, the frequency information, and the sound volume information, which have been used as the playing informations in conventional electronic musical instruments. Furthermore, by tabulating the functional relations between the above-mentioned playing informations and corresponding output waveforms, and storing them in memories, necessary waveforms for sounding the musical instrument can be obtained by only referring to those tables, thereby the speed-up, that is, the realization by hardware, can be realized and thus the sound of brass instruments can be synthesized with fidelity and in real time.

4 Claims, 9 Drawing Sheets

ELECTRONIC MUSICAL INSTRUMENT WITH IMPROVED GENERATION OF WIND INSTRUMENTS

FIELD OF THE INVENTION AND RELATED ART STATEMENT

1. Field of the Invention

The present invention relates to an electronic musical instrument in which the algorithm expressing the sound generation mechanism of wind instruments, particularly of brass instrument is, by employing arithmetic equations and tables, realized using a digital electronic circuit.

2. Description of the Related Art

In recent years, owing to the progress of digital processing technique, a variety of kinds of electronic musical instruments utilizing digital electronic circuits, such as electronic pianos or musical synthesizers, has been developed. In the following, with reference to the drawings, elucidations are given on those conventional electronic musical instruments mentioned above.

FIG. 7 is a block diagram of an electronic musical instrument of prior art. In FIG. 7, numeral 71 designates a controller section which issues, at the time of playing this instrument, the playing information, that is, the sound generation information Kon, the frequency information w, and the sound volume information Ps. Numeral 72 designates an address generation section which calculates addresses of a waveform memory 73 based on the sound generation information Kon and the frequency information w sent out from the controller section 71. Numeral 73 designates the waveform memory from which waveforms are generated based on the addresses sent out from the address generation section 72. Numeral 74 designates an envelope generation section which makes the waveform generation start by detecting the rise-up of the sound generation information Kon sent out from the controller section 71. Numeral 75 designates a multiplier making multiplication operations among the waveform sent out from the waveform memory 73 and the envelope sent out from the envelope generation section 74 and sound volume information Ps sent out from the controller section 71. Numeral 76 designates a digital-to-analog converter making digital-to-analog conversions of the result of multiplication operations sent out from the multiplier 75.

On the conventional electronic musical instrument constituted as described above, explanation is given below.

First, by playing this musical instrument, the sound generation information Kon, the frequency information w, and the sound volume information Ps, all of them constituting the playing information, are sent out from the controller section 71. At the address generation section 72, the address generation is started by detection of the rise-up of the sound generation information Kon. Here, the addresses are obtained by accumulately summing up the read-out skipping interval of the waveform memory corresponding to the frequency information w. Addresses sent out from the address generation section 72 are input into the waveform memory 73, thereby to executing the read-out of the waveform. The waveform thus read out is send to the multiplier 75. At the envelope generation section 74, the generation of the envelope is started by detecting the rise-up of the sound generation information Kon and, at the same time, the envelope thus generated is sent out to the multiplier 75. The multiplication operation among the waveform read out from the waveform memory 73, the envelope sent out from the envelope generation section 74, and the sound volume information Ps sent out from the controller section 71 is processed. The results of the multiplication operation sent out from the multiplier 75 are digital-to-analog converted by the digital-to-analog converter 76, and thus desired musical signal is obtained.

In the prior art electronic musical instruments described above, however, the waveforms stored in the waveform memory are read out only faithfully based on the sound generation information Kon and the frequency information w, and by multiplying the envelope as well as the sound volume informations Ps onto the above-mentioned waveform, thus producing the desired musical signal for those musical instruments, such as piano. Accordingly, playing information thus produced are only the sound generation information Kon corresponding to the key pressing and key releasing, the frequency information w corresponding to the sound interval, and the sound volume information Ps corresponding to the strength of pushing the keyboard. Therefore, the synthesized musical sounds are only faithful. However, for example, for brass instruments, there has been a problem that a faithful musical sound synthesis became very difficult, because they have various factors. That is a brass instrument has, as for the playing informations, the tonguing information To corresponding to the degree of control of vibration of lips using tonguing and the embouchure information Am corresponding to the degree of closing of mouth in addition to the sound generation information Kon, the frequency information w and the sound volume information Ps. These additional factors are important.

Thereupon, a paper was already disclosed in which the sound generation mechanism of brass musical instruments is expressed by equations, and based on these equations the musical sound of brass instruments is synthesized by arithmetic operations (Reference 1: Harmonic Generation in the Trumpet, Authors: John Backus and T. C. Hundley).

In the following, on the contents of the Reference 1, explanation is given with referring to FIG. 8 and FIG. 9. FIG. 8(A) is a vertical sectional drawing of a trumpet used as a model of the musical sound synthesis algorithm developed in Reference 1. In FIG. 8(A), numeral 81 designates lips of a player, numeral 82 designates a mouthpiece of the trumpet, numeral 83 designates a main body part of a cylindrical tube section of the trumpet, numeral 84 designates a bell-shaped opening part of the trumpet. Although in an actual trumpet there are pistons, they are omitted for simplicity in Reference 1. The mouth pressure of a player is expressed by Ps, the degree of opening of lips which acts as a sound generation source (hereinafter called as lips information) by s, the sound pressure in the mouthpiece 82 of the trumpet by Pm, the sound pressure of the main body part of the cylindrical tube section of the trumpet by Po, the sound pressure of the opening part of the trumpet by Pout. The sound actually heard by our ears corresponds to Pout mentioned above. Since the sound volume of the trumpet is controlled by the above-mentioned Ps, it is expressed by the sound volume information Ps explained in the prior art. FIG. 8(C) is a circuital model of the trumpet. In FIG. 8(C), Ps is a driving voltage source (corresponding to the mouth pressure in FIG. 8(A)), Z1 is an impedance of the lips 81 seen from the mouthpiece of the trumpet, Zt is an impedance of the main body part of the cylindrical tube section of the trumpet seen from the mouthpiece 82 of the trumpet, and Pm corresponds to the sound pressure in the mouthpiece in FIG. 8(A). Hereupon, a resultant impedance of Zl and Zt seen from Ps is denoted by Zm. In accordance with this paper, the lips information s is expressed by the below-mentioned equation (1), the sound pressure Pm in the mouthpiece of the trumpet is by the equation (2), Zm is by the equation (3), and Θm is by the equation (4), respectively:

$$s = \tfrac{1}{2} \cdot Xm \cdot (1 - \cos wt), \tag{1}$$

$$Pm = \sum_{n=1}^{6} Bm \cdot Zm \cdot \cos(n \cdot w \cdot t + \Theta m), \tag{2}$$

$$|Zm| = (Rm^2 + Xm^2)^{\frac{1}{2}}, \tag{3}$$

$$\Theta m = \tan^{-1}(Xm/Rm). \tag{4}$$

FIG. 9(A) shows measured values of Rm and Xm and plots of variations of Rm, Xm, |Zm|, Θm with respect to the lips information s based on the Eqs. (3) and (4) (frequency information w and sound pressure information Ps are fixed to a constant value). And it is also stated that values of Rm, Xm, |Zm|, Θm show variations also by the frequency information w and the sound pressure information Ps, and measured values of Rm, |Zm|, Θm with respect to the frequency information w and the sound pressure information Ps are also shown there. From the above statement, it is understood that the sound pressure Pm of the mouthpiece 82 of the trumpet can be obtained from Eq. (1), Eq. (2), and curves on FIG. 9(A). However, the sound of the trumpet we actually hear is Pout shown in FIG. 8(A). Hereupon, if Pout is assumed to be equal to Po, the sound of trumpet can be obtained by clarifying the relation between Pm and Po.

Another paper shown exhibits a method through which the relation between Pm and Po is clarified (Reference 2: Acoustic Nonlinearity of an Orifice, Authors: Uno Ingard and Hartmut Ising).

In the following, the contents of Reference 2 is explained with referring to FIG. 8 and FIG. 9. FIG. 8(B) is a vertical sectional view showing a connected portion of two cylindrical tubes having mutually different cross-sectional area. Letting the pressure in the left-hand side cylinder be P1, the pressure in the right-hand side cylinder P2, the area of a hole existing at the connecting portion of those cylinders Ao, and the velocity of air flow passing through the hole $u_o$, the following equations hold;

$$P1 = \rho \cdot u_o \tag{5}$$

where, when P1 is at low level, $$P1 = \rho \cdot u_o^2 \tag{6}$$

and when when P1 is at high level, $$(P1/P2)^2 = \{(Ro/\rho \cdot c)(A/Ao) - 1\}^2 + \{(Xo/\rho \cdot c)(A/Ao)\}^2 \tag{7}$$

where

ρ is the density of air, c is the velocity of sound.

The resistance component Ro and the reactance component Xo of the impedance of the right-hand side cylindrical tube that is seen from the left-hand side cylindrical tube are measured as a function of $u_o$. Hereupon, assuming that the connecting part of the mouthpiece 82 and the main body part 83 of cylindrical tube section of the trumpet is equivalent to the model of FIG. 8(B) (i.e., P1=Pm, P2=Pout), and moreover, taking P1 of the conditions of Eq. (5) and Eq. (6) to be P1=Po, Eq. (5) to Eq. (7) become to be such as Eq. (8) to Eq. (10). That is, $$Pm = \rho \cdot u_o \tag{8}$$

where, when Ps is at low level, $$Pm = \rho \cdot u_o^2 \tag{9}$$

and when Ps is at high level, $$(Pm/Pout)^2 = \{(Ro/\rho \cdot c)(A/Ao) - 1\}^2 + \{(Xo/\rho \cdot c)(A/Ao)\}^2 \tag{10}$$

where

ρ is the density of air, c is the velocity of sound.

From Eq. (1), Eq. (2), Eq. (8) to Eq. (10) as well as from curves of FIG. 9(A) and (B), Pout with respect to the frequency information w, the time information t, the sound volume information Ps can be determined uniquely. However, in the case that a scheme which is a combination of the above-mentioned Reference 1 and Reference 2 is applied to the actual musical sound synthesis algorithm, yet there is such problem that synthesizing with fidelity of the brass instruments is not possible yet, since no tonguing information nor embouchure information participates to the above-mentioned synthesis algorithm. That is, in the brass instrument the tonguing information To and the embouchure information Am, beside the sound generation information Kon, the frequency information w, and the sound volume information Ps, are important factors as playing informations. Furthermore, there exits a problem that the realization of this algorithm on hardware to get one point on Pout is quite difficult, if we execute arithmetic operations on Eq. (1), Eq. (2), and Eq. (8) to Eq. (10), because of its huge amount of arithmetic operations.

OBJECT AND SUMMARY OF THE INVENTION

The purpose of the present invention is to offer an electronic musical instrument which can synthesize the sound of brass instruments with fidelity and furthermore in real time, using the tonguing information To and the embouchure information Am in addition to the sound generation information Kon, the frequency information w, and the sound volume information Ps.

In order to achieve the above-mentioned purpose, the musical sound synthesis algorithm of the electronic musical instrument of the present invention is taken to be $$s = Am \cdot T\{X'm(s,w,Ps)\} \cdot T\{g(w,t,To)\}, \tag{11}$$

$$Pm = \sum_{n=1}^{6} T\{Bm(n)\} \cdot T\{Z'm(s,w,Ps)\} \cdot \cos\{n \cdot w \cdot t + T\{\Theta m(s,w,Ps)\}\}, \tag{12}$$

$$Pout = T\{Pout(Pm,Ps)\}, \tag{13}$$

where

Am . . . embouchure information, g(w,t,To) . . . table storing the lips movements g which are addressed by the frequency information w, time information t, and the tonguing information To, T{g(w,t,To)} . . . a function which returns a value of g to the table g(w,t,To) storing g when the frequency information w, the time information t, and the tonguing information To are inputted as an address, T{Z'm(s,w,Ps)} . . . a function which returns a value of |Zm| to the table Z'm(s,w,Ps) storing |Zm| in the Reference 1 when the lips information s, the frequency information w, the sound volume information Ps are inputted as an address, T{Θm(s,w,Ps)} . . . a function which returns a value of Θm to the table {Θm(s,w,Ps)} storing Θm in the Reference 1 when the lips information s, the frequency information w, the sound volume information Ps are inputted as an address, T{X'm(s,w,Ps)} . . . a function which returns a value of (½·Xm) to the table X'm(s,w,Ps) storing values of Xm in the Reference 1 multiplied by ½, i.e., (½·Xm), when the lips information s, the frequency information w, the sound volume information Ps are inputted as an address, T{Bm(n)} . . . a function which returns a value of Bm to the table Bm(n) storing Bm in the Reference 1 when the harmonics order n is inputted as an address, T{Pout(Pm,Ps)} . . . a function which returns a value of Pout to the table Pout(Pm,Ps) storing Pout which is calculated based upon Eq. (8) to Eq. (10) in the Reference 1 and measured values Ro, Xo of FIG. 9(B) when Pm and the sound volume information Ps are inputted as an address, and other variables are the same as in the Reference 1.

The electronic musical instrument of the present invention comprises:

a controller section which issues the sound generation information Kon, the frequency information w, the sound volume information Ps, the tonguing information To, and the embouchure information Am as the playing information, a counter section which starts the count of the time information responding to the sound generation signal Kon sent out from the above-mentioned controller section, a lips movement section which calculates the lips information s by executing Eq. (11) from an output value g of a table that is referred by the frequency information w, the sound volume information Ps, and the tonguing information To sent out from the above-mentioned controller section and the time information t sent from the above-mentioned counter section, and from an output value (½·Xm) of a table that is referred by the embouchure information Am, the lips information s, the frequency information w, and the sound volume information Ps sent from the above-mentioned controller section, a waveform generation section which calculates Pm by executing Eq. (12) from output values |Zm| and Θm of two tables that are referred by the lips information s sent out from the lips movement section and the frequency information w and the sound volume information Ps sent out from the above-mentioned controller section, from an output value Bm of a table referred by the harmonic order n and the frequency information w sent out from the above-mentioned controller section, and from the time information t sent out from the above-mentioned counter section, and at the same time, which makes the output value Pout of a table referred by the above-mentioned Pm and the sound volume information Ps sent out from the above-mentioned controller section as the waveform data Pout by Eq. (13), and a digital-to-analogue converter section performing the digital-to-analogue conversion of the waveform data Pout sent out from the above-mentioned waveform generation section.

By the constitution described above, since the table g(w,t,To) which stores the mouth-lips movements at the time of playing a brass instrument, is selected by the tonguing information sent from the controller section, tone of the musical sound signal can be changed by the change of the tonguing information To. Since the lips information s is calculated based on the embouchure information Am sent out from the above-mentioned controller section, tone of the musical sound signal can be changed by varying the embouchure information. Furthermore, by tabulating |Zm|, Θm, Xm, and Bm (used in the musical sound synthesis algorithm described in Reference 1 and Reference 2) and Pout (calculated from measured values of Ro and Xo shown in Eq, (8) to Eq. (10) and FIG. 9(B)), |Zm|, Θm, Xm, Bm, and Pout become to be obtained by merley referring to this table. This can be realized by hardware. Therefore, the sound of brass instruments can be synthesized with fidelity and in real time using, as the playing information, the tonguing information To and the embouchure information Am in addition to the sound generation information Kon, the frequency information w, and sound volume information Ps.

DESCRIPTION OF THE PREFERRED EMBODIMENTS

Figure 1:
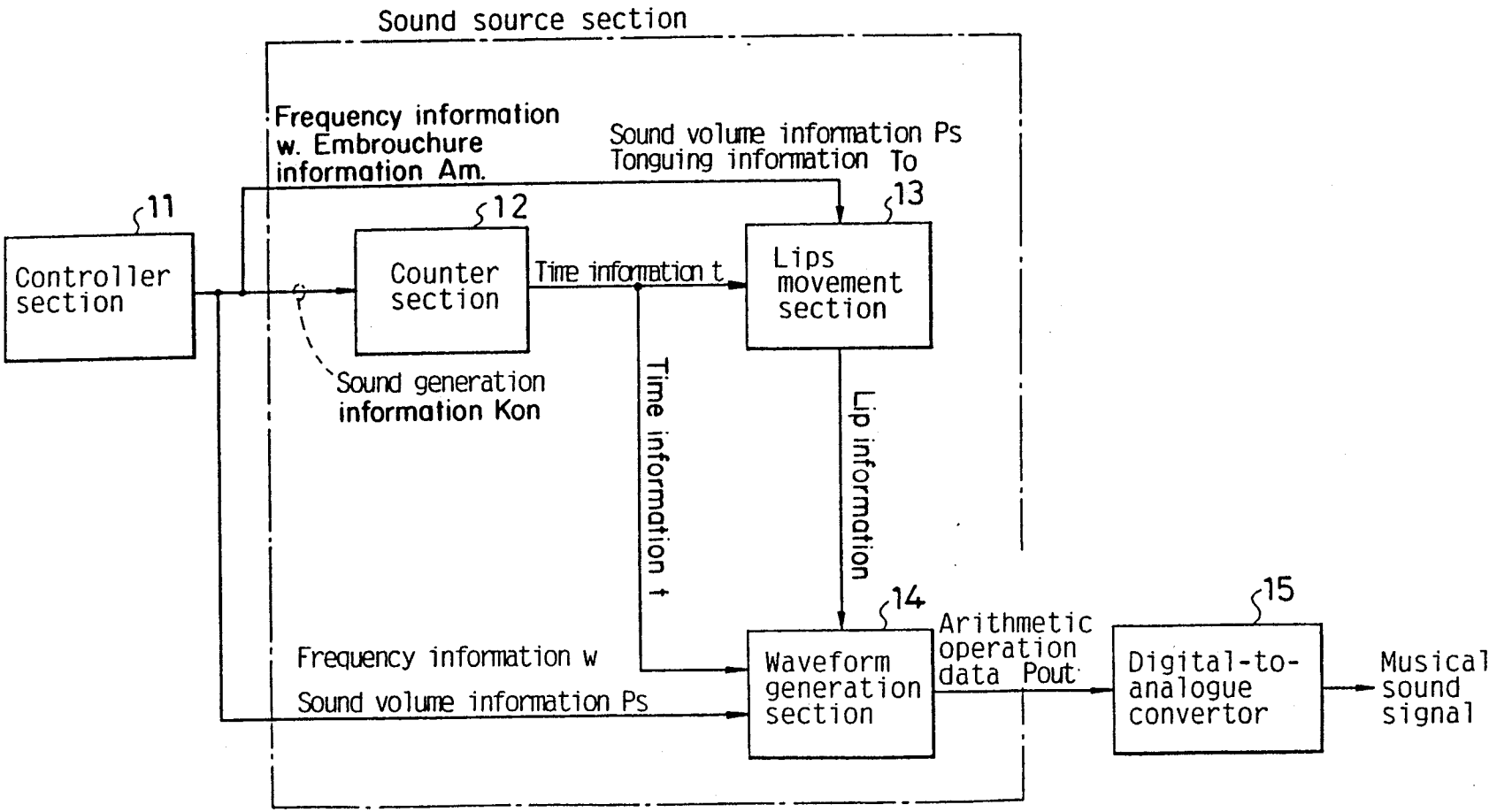
FIG. 1 is a block diagram of an electronic musical instruments in one working example of the present invention.

FIG. 1 shows a block diagram of an electronic musical instrument in the present working example. In FIG. 1:

Numeral 11 is a controller section for sending out the sound generation information Kon, the frequency information w, the sound volume information Ps, the tonguing information To, the embouchure information Am, which constitutes the playing information.

Numeral 12 is a counter section which starts counting of the time information t by the sound generation signal Kon sent out from the controller section 11.

Numeral 13 is a lips movement section which calculates the lips information s by executing Eq. (11) from an output g and an output value $(\frac{1}{2}\cdot Xm)$; wherein the output value g is issued from a table that is referred by the frequency information w, the sound volume information Ps, and the tonguing information To sent out from the controller section 11 and the time information t sent out from the counter section 12, and the other output value $(\frac{1}{2}\cdot Xm)$ is issued from a table that is referred by the embouchure information Am, the lips information s, the frequency information w, and the sound volume information Ps sent out from the controller section 11.

Numeral 14 is a waveform generation section which calculates Pm by executing Eq. (12) from: (i) output values Zm and $\Theta m$ of two tables that are referred by the lips information s sent out from the lips movement section 13 and the frequency information w and the sound volume information Ps sent out from the controller section 11; (ii) an output value Bm of a table referred by the harmonic order n and the frequency information w sent out from the controller section 11; and (iii) the time information t sent out from the section 12, and at the same time, which makes the output value Pout of a table referred by the above-mentioned Pm and the sound volume information Ps as the waveform data Pout by Eq. (13).

And, numeral 15 is a D-A converter section performing the digital-to-analog conversion of the waveform data Pout sent out from the waveform generation section 14.

Figure 2:
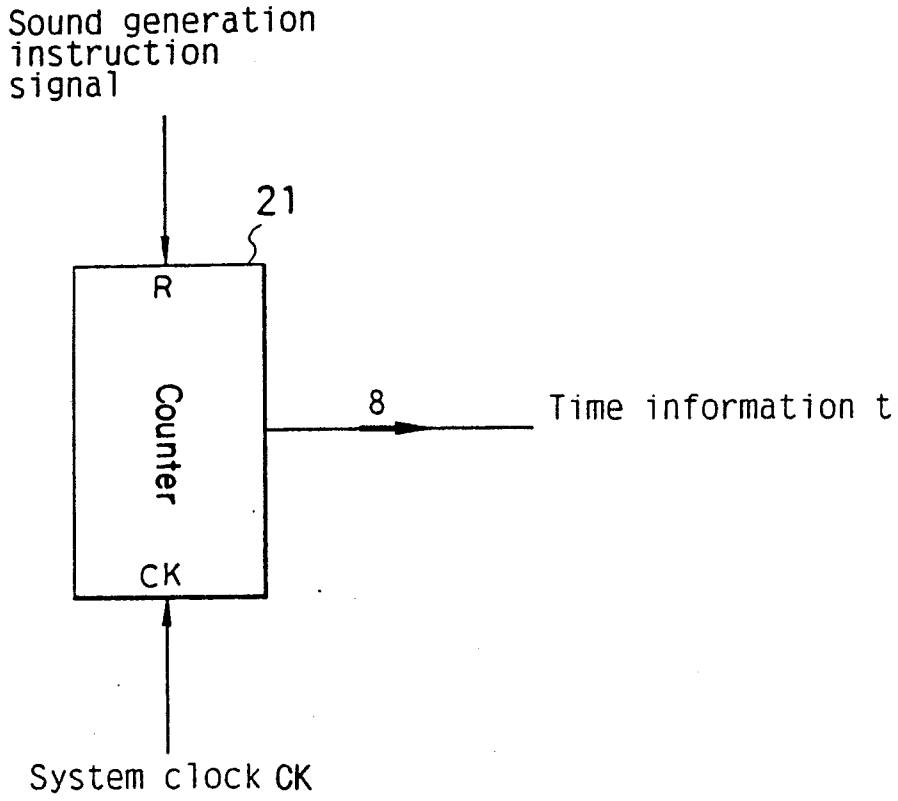
FIG. 2 is a circuit diagram of a counter section.

FIG. 2 is a circuit diagram showing the counter section 12 in the present working example. In FIG. 2, numeral 21 is a counter which resets the counts by the sound generation information Kon and at the same time counts up the counts by the input of the system clock CK and sends this counted value to the lips movement section 13 as well as to the waveform generation section 14 as the time information t.

Figure 3:
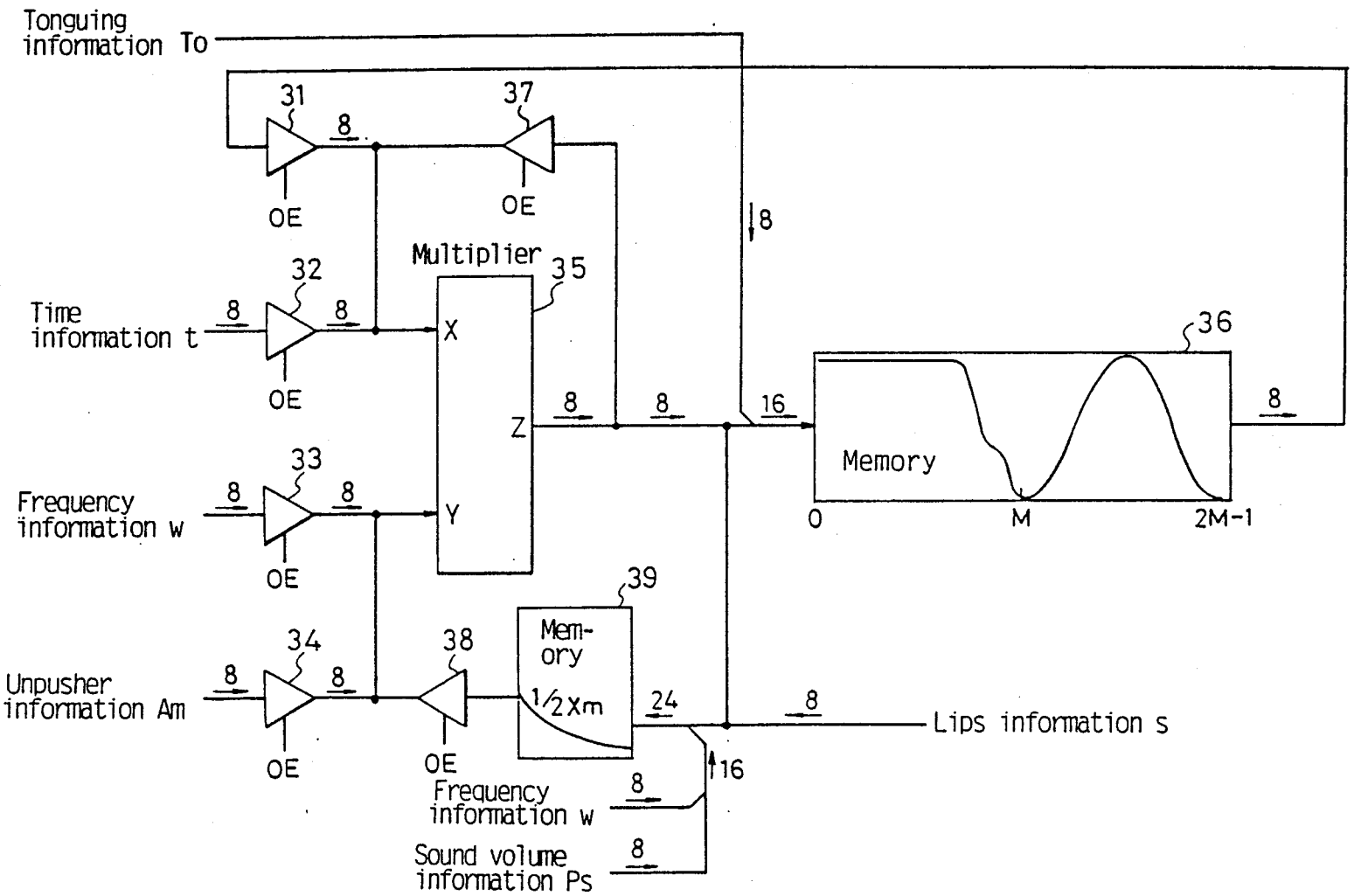
FIG. 3 is a circuit diagram of a lips movement section.

FIG. 3 is a circuit diagram showing the lips movement section 13 in the present working example. In FIG. 3, numeral 31 is a three-state buffer which sends out the output of a memory 36 storing the lips movement to an input X of a multiplier 35 at the time when the out-enable signal OE is "high". Numeral 32 is is a three-state buffer which sends out the time information t to the input X of the multiplier 35 at the time when the out-enable signal OE is "high". Numeral 33 is a three-state buffer which sends out the frequency information w to an input, Y of the multiplier 35 at the time when the out-enable signal OE is "high". Numeral 34 is a three-state buffer which sends out the embouchure information Am to the input Y of the multiplier 35 at the time when the out-enable signal OE is "high". Numeral 37 is a three-state buffer which sends out the output (Am·Xm) of the multiplier 35 to the input X of the multiplier 35 at the time when the out-enable OE is "high". Numeral 38 is a three-state buffer which sends out the output value $(\frac{1}{2}\cdot Xm)$ of a memory 39 to the input Y of the multiplier 35 at the time when the out-enable signal OE is "high". Numeral 36 is a memory which stores the table g(w,t,To) of FIG. 5(G). Numeral 39 is a memory which stores the table X'm(s,w,Ps) of FIG. 5(A). Numeral 35 is a multiplier which makes multiplication operation between the input X and the input Y, and sends out the result of multiplication operation (w,t) to the memory 36 as the address of the memory 36. At the same time, the multiplier 35 sends out the result of multiplication, $(Am\cdot(\frac{1}{2})\cdot Xm\cdot g)$ to the waveform generation section 14 as well as to the memory 39 as the lips information s.

Figure 4:
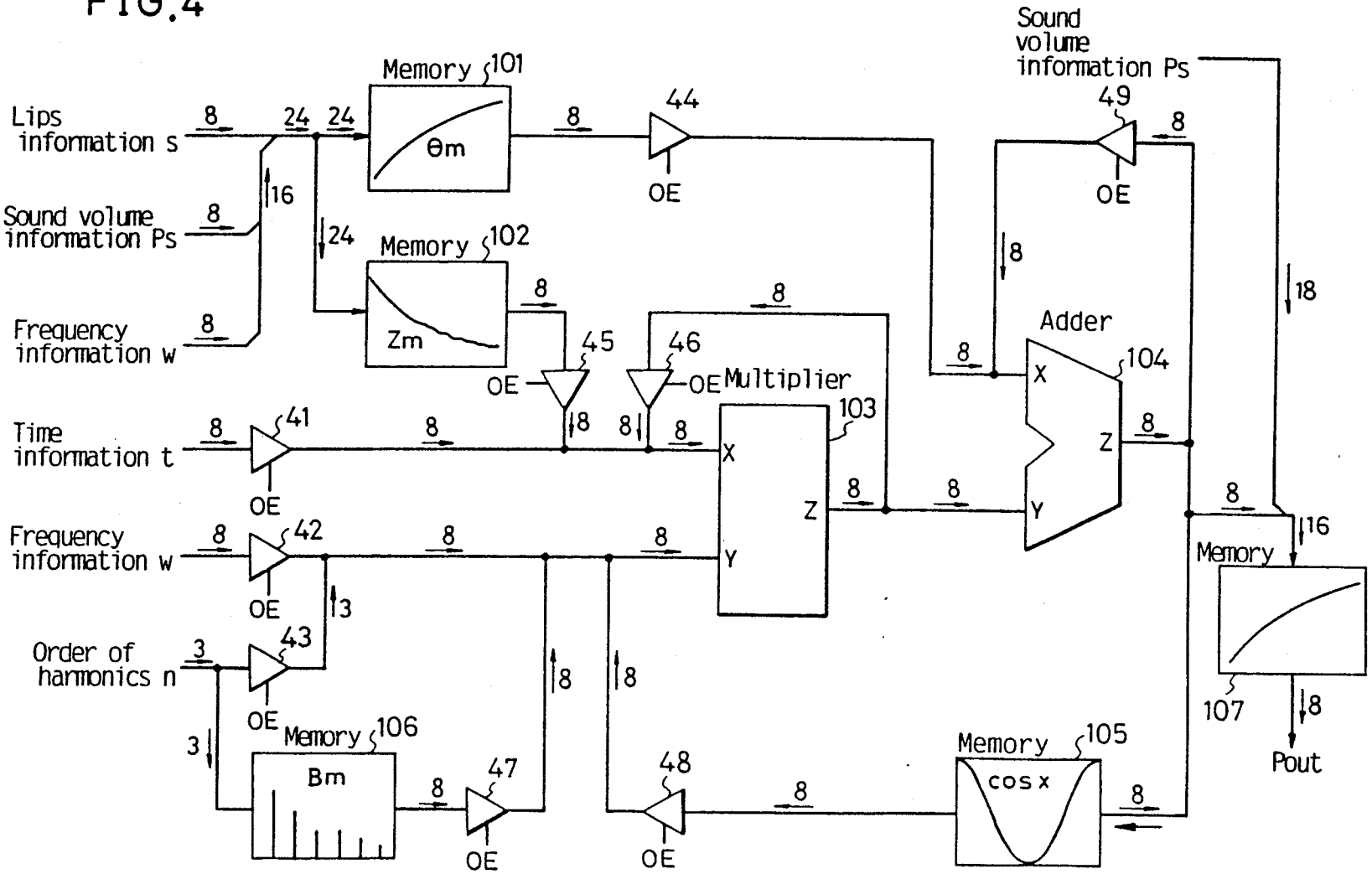
FIG. 4 is a circuit diagram of a waveform generation section.

FIG. 4 is a circuit diagram showing a waveform generation section 14 in the present working example. In FIG. 4, numeral 41 is a three-state buffer which sends out the time information t to an input X of a multiplier 103 at the time when the out-enable signal OE is "high". Numeral 42 is is a three-state buffer which sends out the frequency information w to an input Y of the multiplier 103. Numeral 43 is a three-state buffer which sends out the harmonics order n to the input Y of the multiplier 103 at the time when the out-enable signal OE is "high". Numeral 44 is a three-state buffer which sends out the output of a memory 101 to an input Y of a multiplier 104 at the time when the out-enable signal OE is "high". Numeral 45 is a three-state buffer which sends out the output of a memory 102 to the input X of the multiplier 103 at the time when the out-enable signal OE is "high". Numeral 46 is a three-state buffer which sends out the output of the multiplier 103 to the input X of the multiplier 103 at the time when the out-enable signal OE is "high". Numeral 47 is a three-state buffer which sends out the output of a memory 106 to the input Y of the multiplier 103 at the time when the out-enable signal OE is "high". Numeral 48 is a three-state buffer which sends out the output of a memory 105 to the input Y of the multiplier 103 at the time when the out-enable signal OE is "high". Numeral 49 is a three-state buffer which sends out the output of an adder 104 to an input X of the adder 104 at the time when the out-enable signal OE is "high". Numeral 101 is a memory storing a table Θm(s,w,Ps) and issues Θm having the lips information s, the sound volume information Ps, and the frequency information w as its address input. Numeral 102 is a memory storing the table Z'm(s,w,Ps) of FIG. 5(B) and issues |Zm| with having the lips information s, the sound volume information Ps, and the frequency information w as its address input. Numeral 103 is a multiplier which makes multiplication operation between the input X and the input Y and sends out the result of multiplication operation, (n·w·t), to an input Y of the adder 104. At the same time the multiplier 103 sends the result of multiplication operation, (w·t), and (|Zm|·cos(n·w·t+Θm)) to the three-state buffer 46. Numeral 104 is the adder which performs an addition operation between the input X and the input Y and sends out the result of the addition operation, (n·w·t+Θm), to the memory 105 and sends out the result of the addition operation, $$\left(\sum_{n=1}^{k} Bm \cdot |Zm| \cdot \cos(n \cdot w \cdot t + \Theta m)\right),$$

where k=6) to the three-state buffer 49. The adder 104 also sends out the result of the addition operation, Pm, to a memory 107. Numeral 105 is a memory which stores the one period data of cos(x) of FIG. 5(H), receives the result of addition operation, (n·w·t+Θm) (sent out from the adder 104) as the address value x, and issues cos(n·w·t+Θm). Numeral 106 is a memory which stores the table Bm(n) of FIG. 5(D), receives the harmonics order n as its address value, and issues the harmonics coefficient Bm. Numeral 107 is a memory which stores the table Pout(Pm,Ps) of FIG. 5(E), receives the sound volume information Ps (sent out from the controller section 11) as its address value, and issues Pout.

Figure 5A:
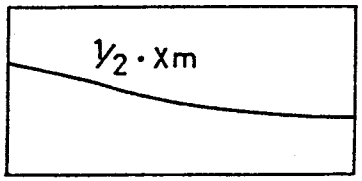
FIG. 5(A) is a table X'm(s,w,Ps) storing values of (½·Xm), that are values of ½ times Xm which is the reactance component of the input impedance Zm of the trumpet.

FIG. 5(A) is a graph showing tabulated values of measured values Xm in the Reference 1 multiplied by ½, (½·Xm), which is, in the present working example, denoted as X'm(s,w,Ps). Hereupon, this table is addressed by the lips information s. There are multiple sets of this table, and they are selected by the frequency information w and the sound volume information Ps.

Figure 5B:
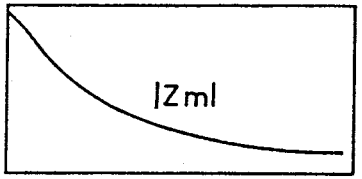
FIG. 5(B) is a table Z'm(s,w,Ps) storing absolute values |Zm| of the input impedance Zm of the trumpet.

FIG. 5(B) is a graph showing tabulated values of measured values |Zm| in the Reference 1, which is, in the present working example, denoted as Z'm(s,w,Ps). Hereupon, this table is addressed by the lips information s. There are multiple sets of this table, and they are selected by the frequency information w and the sound volume information Ps.

Figure 5C:
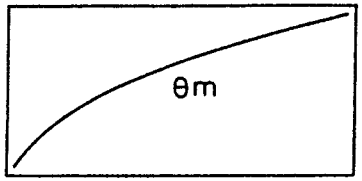
FIG. 5(C) is a table Θm(s,w,Ps) storing phase angle components Θm of the input impedance Zm of the trumpet.

FIG. 5(C) is a graph showing tabulated values of measured values Θm in the Reference 1, which is, in the present working example, denoted as Θm(s,w,Ps). Hereupon, this table is addressed by the lips information s. There are multiple sets of this table, and they are selected by the frequency information w and the sound volume information Ps.

Figure 5D:
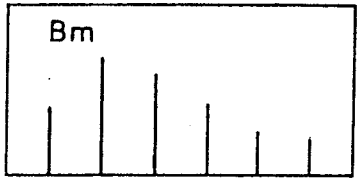
FIG. 5(D) is a table Bm(n) storing the harmonic coefficients Bm.

FIG. 5(D) is a graph showing tabulated values of the harmonic coefficients Bm, which are, in the present embodiment, denoted as Bm(n). Hereupon, this table is addressed by the harmonics order n.

Figure 5E:
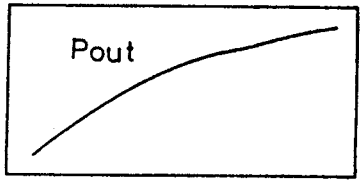
FIG. 5(E) is a table Pout(Pm,Ps) storing the waveform data Pout.
Figure 9:
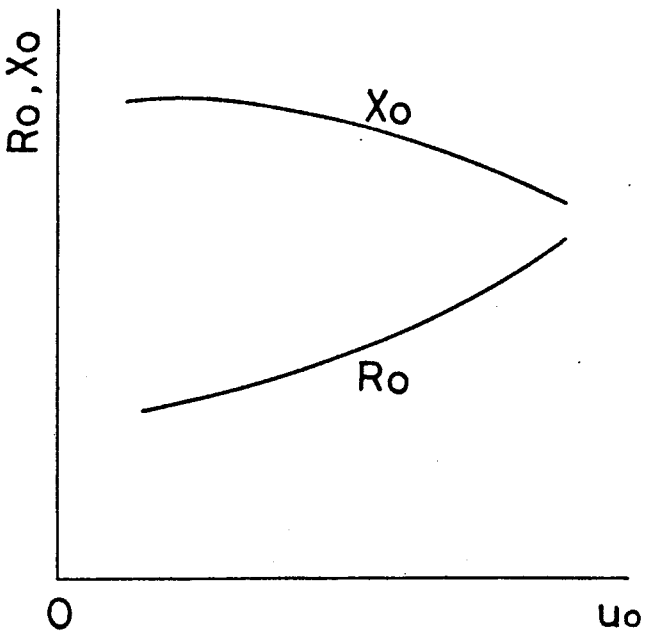
FIG. 9(A) is a graph plotting absolute values $|Zm|$ of the impedance Zm seen from the mouthpiece of the trumpet, the resistance component Rm and the reactance component Xm of Zm, and the phase angle component $\Theta m$ of Zm.
FIG. 9(B) is a graph plotting the resistance component Ro and the reactance component Xo of the impedance of the cylindrical tube on the right hand side seen from the cylindrical tube on the left hand side in FIG. 6(B)
Figure 9:
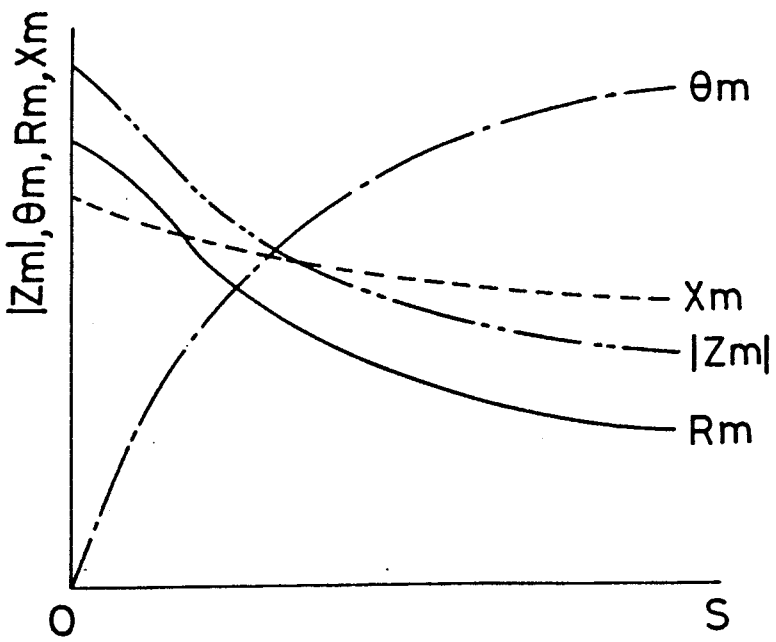

FIG. 5(E) is a graph showing tabulated values representing a relation of Pout with respect to Pm and Ps obtained by Eqs. (8) to (10) and FIG. 9(B) in the Reference 2, which are, in the present working example, denoted as Pout(Pm, Ps). There are multiple sets of this table, and they are selected by the sound volume information Ps.

Figure 5F:
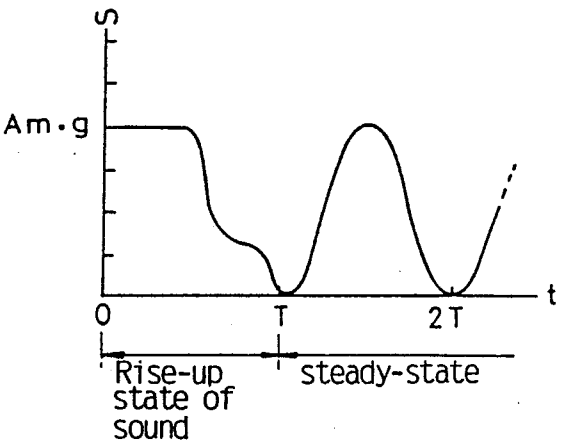
FIG. 5(F) is a graph plotting the lips information s with respect to time information t (where (½·Xm)=1)

FIG. 5(F) is a graph plotting the lips information s in the present working example with respect to the time information t. Hereupon, for simplicity, (½·Xm)=1 is assumed.

Figure 5G:
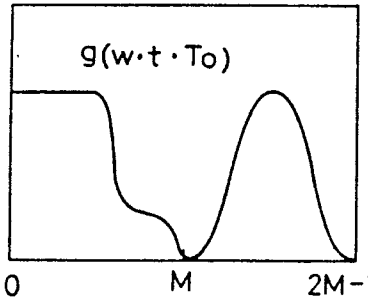
FIG. 5(G) is a table g(w,t,To) storing the lips movements.

FIG. 5(G) is a graph showing tabulated values of the degree of the mouth lips opening shown in FIG. 5(F) divided by the embouchure information Am and (½·Xm) and denoted as g(w,t,To). Hereupon, this table is addressed by a value (w·t) which is the multiplication between the frequency information w and the time information t. In addresses 0 to M-1, values at the time of the rise-up state of the sound (tonguing time) are stored, whereas in addresses M to 2M-1, values at the time of the steady-state of the sound are stored. And there are multiple sets of this table, which are selected by the tonguing information To.

Figure 5H:
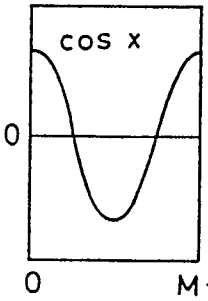
FIG. 5(H) is a cosine table.

FIG. 5(H) is a cosine table for executing Eq. (9) in the processing section in the present working example, and they are addressed by (n·w·t+Θm).

Figure 6:
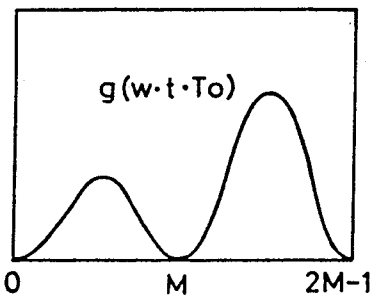
FIG. 6(A) is a table g(w,t,To) storing lips movements (case of dull tonguing)
FIG. 6(B) is a graph plotting the lips information s with respect to the time information t (case of the dull tonguing, where (½·Xm)=1)
FIG. 6(C) is a table g(w,t,To) storing lips movements (case of the sharp tonguing)
FIG. 6(D) is a graph plotting the lips information s with respect to the time information t (case of the sharp tonguing, where $(\frac{1}{2}\cdot Xm)=1$)
Figure 6:
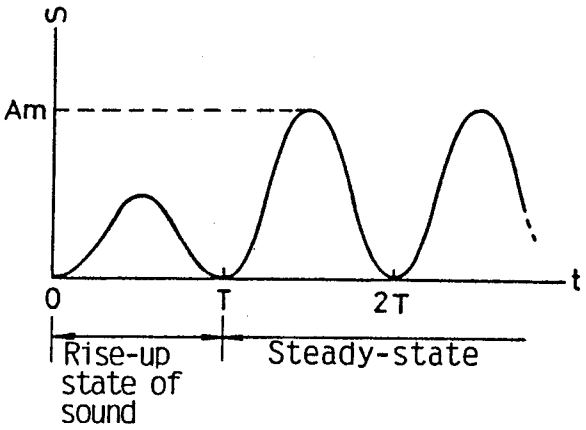
Figure 6:
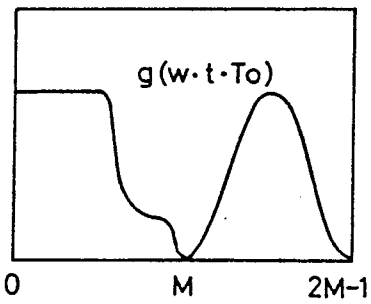
Figure 6:
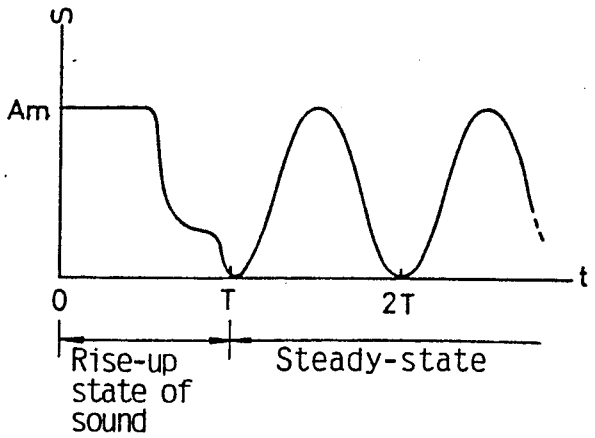
Figure 7:
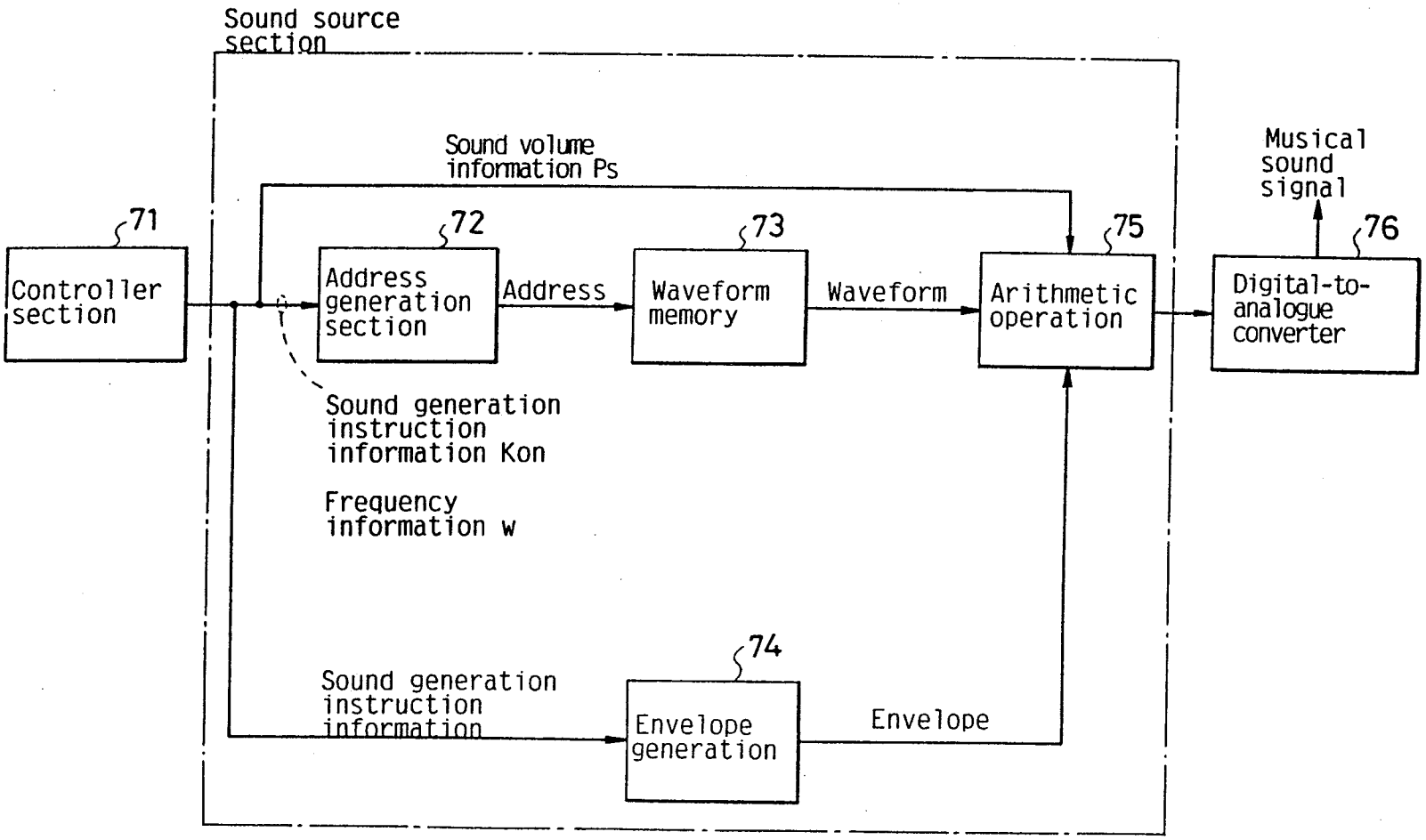
FIG. 7 (PRIOR ART)
FIG. 7 is a block diagram of a conventional electronic musical instrument.

FIG. 6(A) shows an example of the case that dull tonguing is done in the table g(w,t,To) in the present embodiment.

Figure 8:
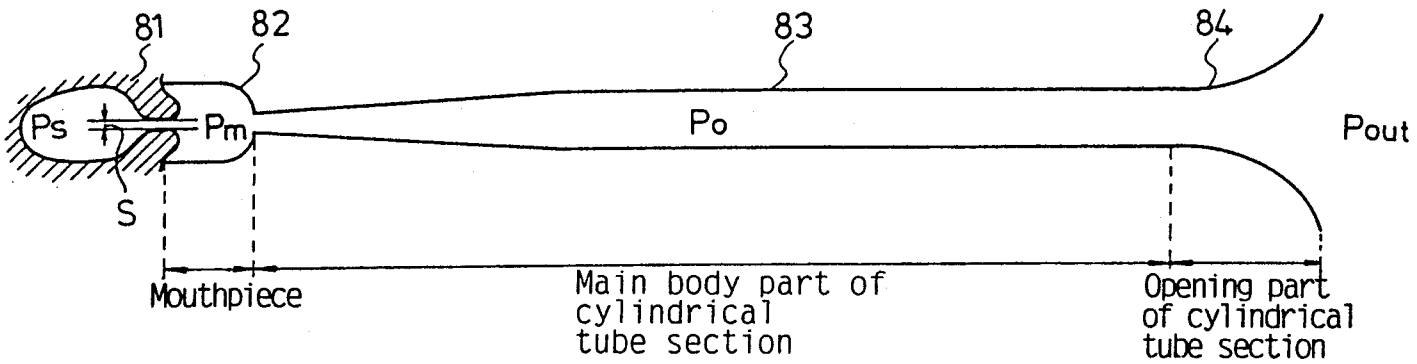
FIG. 8(A) is a vertical cross-sectional view of a trumpet.
FIG. 8(B) is a sectional view showing a connection of cylindrical tubes whose sectional areas are different from each other.
FIG. 8(C) is a circuit diagram which is a circuit model used for approximating the sound generation mechanism of the trumpet.
Figure 8:
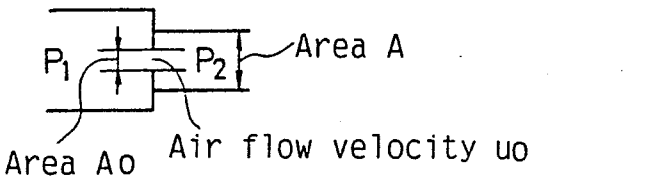
Figure 8:
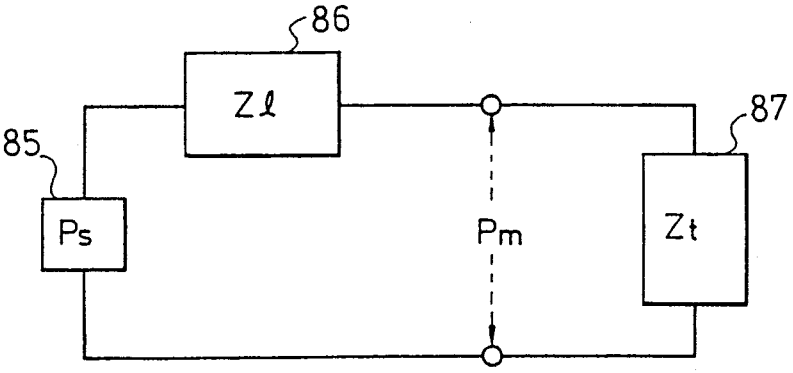

FIG. 6(B) is a graph plotting the lips information s in the present embodiment with respect to the time information t, and it shows the state of lips in case that the table of FIG. 8(A) is used. Hereupon, for simplicity, (½·Xm)=1 is assumed.

FIG. 6(C) shows an example of the case that sharp tonguing is done in the table g(w,t,To) in the present embodiment.

FIG. 6(D) is a graph plotting the lips information s in the present embodiment with respect to the time information t, and it shows the state of lips in case that the table of FIG. 8(C) is used. Hereupon, for simplicity, (½·Xm)=1 is assumed.

On an electronic musical instrument constituted as described above, its operation is explained below with reference to FIG. 1 to FIG. 6.

In FIG. 1, by playing this instrument, the sound generation information Kon, the frequency information w, the sound volume information Ps, the tonguing information To, the embouchure information Am, all of which are the playing information, are issued. The sound generation information Kon is sent to the counter section 12 to start the count of the time information t.

The frequency information w, the embouchure information Am, and the tonguing information To are sent to the lips movement section, wherein Eq. (1) is executed. The frequency information w and the sound volume information Ps are sent to the waveform generation section, wherein Eq. (12) is executed.

First in FIG. 2, operations of the counter section 12 is explained. By selecting the rise-up of the sound generation information Kon, the counter 21 of the counter section 12 resets the time information t, which is on way of counting at the present moment. Thereafter, during the time that the sound generation information Kon is being generated, the time information t is counted up by the timing of generation of the system clock CK, and then, it is sent to the lips movement section as well as to the sound generation section 14. Hereupon, the counter 21 is supposed to start the count from 0 and, at the time when the count reaches 2M, the count is reset to a count value M. Thereafter it keeps counting repeatedly between M and 2M.

Next, with reference to FIG. 3, the operation of the lips movement section 13 is explained. In the lips movement section 13, the multiplication operation between the time information t from the counter section 12 and the frequency information w from the controller section 11 is executed in the multiplier 35, thereby to obtain (w,t). The product (w,t) is input to the memory 36 (storing the table g(w,t,To) as its address. The tonguing information To sent from the the controller section 11 selects one to the tables g(w,t,To) in the memory 36. After inputting of g (which was read out from the memory 36) into the input X of the multiplier 35 through the three-state buffer 31, a multiplication operation thereof with the embouchure information Am from the controller section 11 is executed in the multiplier 35. The result of this multiplication operation, (Am·g) is input to the input X of the multiplier 35 through the three-state buffer 37. A multiplication operation with data ($\frac{1}{2}$·Xm) read out from the memory 39 is executed. Hereupon, since the lips information s was not determined yet at the initial start time, the memory 39; issues any initial trial values among those values stored therein. The output (Am·($\frac{1}{2}$)·Xm·g) issued from the multiplier 35 is sent out to the memory 39 as well as to the waveform generation section 14 as the lips information s. The lips information s sent out to the memory 39 addresses the table X'm(s,w,Ps) in the memory 39 which has been selected by the frequency information w and the sound volume information Ps which were sent out from the controller 11. Thereby, data ($\frac{1}{2}$·Xm) which is to be used for the next arithmetic operation is read out. By the above-mentioned operation, different from the conventional operation shown in Eqs. (1), (2), (8) to (10), the lips information s at the rise-up of the sound is first sent to the waveform generation section 14 as shown in FIG. 5(F). Thereafter the lips information s at the steady-state is sent out to the waveform generation section 14. This part of operation is explained more in detail with reference to FIG. 6. The tonguing information To sent out from the controller section 11 selects either one from (A) or (C) of FIG. 6. If a musical tone corresponding to the dull tonguing is intended to obtain, it is enough to send the tonguing information To that selects the table g(w,t,Ps) shown in FIG. 6(A). From this, it is understood that the musical sound synthesis responding to the tonguing information becomes possible. For example, since the lips information s is controlled by the embouchure information Am sent out from the controller section 11, musical sounds corresponding to blows with relaxed mouth-shapes can be accomplished by only taking large embouchure information Am when. Conversely, when musical sounds corresponding to blows with tightened mouth shapes, also can also be accomplished by only taking small embouchure information Am.

Finally, the operation of the waveform generation section 14 is explained by using FIG. 4. In the waveform generation section 14, arithmetic operations of Eq. (9) are executed. First, a multiplication operation between the time information t sent out from the counter section 12 and the frequency information w sent out from the controller section 11 is done in the multiplier 103. Then a multiplication operation between the result of this multiplication operation, (w·t), and the harmonics order n is done also in the multiplier 103. Thereby, the result of this multiplication operation, (n·w·t), is issued. Hereupon, the harmonics order n in the present working example takes integer numbers of 1 to 6, which corresponds to the coefficient n in the accumulation addition operation in Eq. (9). Next, the lips information s sent out from the lips movement section 13, the frequency information w sent out from the controller section 11, and the sound volume information Ps are sent out to the memory 101 (which stores the table Z'm(s,w,Ps) shown in FIG. 5(B)) as well as to the memory 102 (which stores the table Θm(s,w,Ps) shown in FIG. 5(C)) as their addresses, and thereby |Zm| and Θm are read out. The above-mentioned result of multiplication operation, (n·w·t), and Θm are added to each other in the adder 104, thereby (n·w·t+Θm) is obtained. This (n·w·t+Θm) is inputted to the memory 105 as its address, thereby cos(n·w·t+Θm) is calculated, and inputted to the input Y of the multiplier 103. In the multiplier 103, a multiplication operation among cos(n·w·t+Θm), |Zm| which was read out from the memory 102, and Bm read out from the memory 106 is executed and the result Bm·|Zm|·cos (n·w·t+Θm) is sent out to the input Y of the adder 104. In the adder 104, the accumulation addition of respective Bm·|Zm|·cos (n·w·t+Θm) for the harmonics order n of 1 to 6 is executed, and thus the left hand side of Eq. (2), Pm, is calculated. Pm thus obtained is inputted as the address to the table Pout(Pm, Ps) in the memory 107 which was selected by the sound volume information Ps sent out from the controller section 11, and thus the output Pout is issued.

As has been described above, in accordance with the present working example, the sound of brass instruments can be synthesized with fidelity and moreover in real time, using, as the playing information, the tonguing information To and the embouchure information Am in addition to the sound generation Kon, the frequency information w, and sound volume information Ps, by utilizing information such that:

in an algorithm expressing the sound generation mechanism of the brass musical instruments with mathematical equations given by $$s = Am \cdot T\{X'm(s,w,Ps)\} \cdot T\{g(w,t,To)\},$$

$$Pm = \sum_{n=1}^{6} T\{Bm(n)\} \cdot T\{Z'm(s,w,Ps)\} \cdot \cos\{n \cdot w \cdot t + T\{\Theta m(s,w,Ps)\}\},$$

$$Pout = T\{Pout(Pm,Ps)\},$$

by dividing the table g(w,t,To) into a region expressing the rise-up state of the sound and a region expressing the steady-state, and at the same time, by selecting the table g(w,t,To) by the tonguing information sent out from the controller section 11, also by calculating the lips information s based on the embouchure information Am sent out from the controller section 11, and by tabulating |Zm|, Θm, Xm, and Bm in the Reference 1 and Pout that was used to be calculated by Eq, (8) to Eq. (10) and measured values of Ro and Xo shown in FIG. 9(B).

What is claimed is:

1. An electronic musical instrument comprising:

a controller section which sends out, as playing information, sound generation information Kon, frequency information w, sound volume information Ps, tonguing information To, and embouchure information Am;

a lip movement section which calculates lip information s indicating a degree of opening of lips in accordance with the playing information (To,W-,Am,Ps) sent out from said controller section;

a waveform generation section which generates desired waveform data Pout in accordance with the lip information s calculated from said lip movement section and the frequency information w, and the sound volume information Ps sent out from said controller section; and a digital-to-analog converter for making digital-to-analog conversions of the waveform data Pout sent out from said waveform generation section.

2. An electronic musical instrument in accordance with claim 1 wherein:

said lip movement section calculates the lip information s by selecting one table corresponding to tonguing information To from at least two tables.

3. An electronic musical instrument in accordance with claim 1 wherein:

said lip movement section calculates the lip information s by multiplying data for calculating the lip information s stored in a memory with embouchure information Am.

4. An electronic musical instrument comprising:

a controller section which sends out, as playing information, sound generation information Kon, frequency information w, sound volume Ps, tonguing information To, and embouchure information Am;

a lip movement section which calculates lip information s indicating a degree of opening of lips in accordance with the playing information (To,w-,Am,Ps) sent out from said controller section and one table corresponding to the tonguing information to be selected from tables g(w,t,To) stored in a memory, by executing an equation (A);

a waveform generation section which generates desired waveform data Pout in accordance with the lip information s calculated from said lip movement section and the frequency information w, and the sound volume information Ps sent out from said controller section by executing equations (B) and (C); and a digital-to-analog converter making digital-to-analog conversations of the waveform data Pout sent out from said waveform generation section wherein the equations (A), (B) and (C) can be expressed as:

$$s = Am \cdot T\{Xm(s,w,Ps)\} \cdot T\{g(w,t,To)\} \qquad \text{A}$$

$$Pm = \sum_{n=1}^{6} T\{Bm(n)\} \cdot T\{Zm(s,w,Ps)\} \cdot \cos\{n \cdot w \cdot t + T\{Om(s,w,Ps)\}\} \qquad \text{B}$$

$$Pout = T\{Pout(Pm,Ps)\} \qquad \text{C}$$

wherein T{g(w,t,To)} is a function which returns a value of g from a first table g(w,t,To) storing g, T{Zm(s,w,Ps)} is a function which returns a value of Zm from a second table Zm(s,w,Ps) storing Zm, T{Om(s,w,Ps)} is a function which returns a value of m from a third table Om(s,w,Ps) storing m, T{Xm(s,w,Ps)} is a function which returns a value Xm from a fourth table Xm(s,w,Ps) storing values of Xm, T{Bm(n)} is a function which returns a value of Bm from a fifth table Bm(n) storing Bm, and T{Pout(Pm,Ps)} is a function which returns a value of Pout from a sixth table Pout(Pm,Ps) storing Pout.

* * * * *